US008985324B2

(12) United States Patent
Aloia

(10) Patent No.: US 8,985,324 B2
(45) Date of Patent: Mar. 24, 2015

(54) DRINK MIX CONTAINER

(71) Applicant: Roland Aloia, Yucaipa, CA (US)

(72) Inventor: Roland Aloia, Yucaipa, CA (US)

( * ) Notice: Subject to any disclaimer, the term of this patent is extended or adjusted under 35 U.S.C. 154(b) by 0 days.

(21) Appl. No.: 13/932,835

(22) Filed: Jul. 1, 2013

(65) Prior Publication Data

US 2014/0001064 A1 Jan. 2, 2014

Related U.S. Application Data

(60) Provisional application No. 61/666,677, filed on Jun. 29, 2012.

(51) Int. Cl.
*B65D 81/32* (2006.01)

(52) U.S. Cl.
CPC ..... *B65D 81/3211* (2013.01)
USPC ..... 206/221

(58) Field of Classification Search
CPC ..... B65D 81/3211; A61J 1/2093
USPC ..... 206/219, 222; 215/DIG. 8
See application file for complete search history.

(56) References Cited

U.S. PATENT DOCUMENTS

| | | | | |
|---|---|---|---|---|
| 2004/0060831 | A1* | 4/2004 | De Laforcade | 206/219 |
| 2010/0025356 | A1* | 2/2010 | Lee et al. | 215/227 |
| 2012/0217178 | A1* | 8/2012 | Rohr et al. | 206/219 |

* cited by examiner

*Primary Examiner* — David Fidei
(74) *Attorney, Agent, or Firm* — Knobbe Martens Olson & Bear LLP

(57) ABSTRACT

A drink mix container having two openings with two caps. One opening is adapted to be positioned on a drink container. The drink mix container includes a plug attached to an opening that is not positioned on the drink container. The plug seals a receptacle and inhibits the drink mix from falling into the drink container upon removal of the first cap.

17 Claims, 9 Drawing Sheets

DRINK MIX CONTAINER

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. This application claims the benefit under 35 U.S.C. §119 of U.S. Provisional Application No. 61/666,677 filed Jun. 29, 2012 entitled Drink Mix Container.

BACKGROUND OF THE INVENTION

1. Field of the Invention

The present invention relates to drink mix containers and, in particular, concerns container designs that are adapted to be sold for use with commercially-available water bottles or suitable drink bottles and can function as both a receptacle for a drink mix and also provide a cap for existing drink bottles or containers.

2. Description of the Related Art

Drink mixes for use with water or other beverages sold in containers such as bottles are well known. Examples of such mixes include nutritional supplements and flavor supplements as well as other mixes that can be used to enhance a drink. As a further example, an energy drink mix can be formulated for use with water bottles.

Nutritional, energy, and/or medical ingredients found in pre-mixed liquid beverages are well known in the marketplace. Powdered mixes of similar nutritional, energy and medical ingredients are less known and less available in the commercial marketplace. One reason for this is the inconvenience of using such powdered mixtures and adding them to commercial water bottles. The process of adding powdered ingredients to water bottles involves removing some of the water from the water bottle to make room for the addition of the powdered mixture. Subsequently, the powder must be dispensed into the water bottle.

Drink mixes offer several advantages over pre-mixed drinks, one of which is that if the drink mix is in a dry form, its shelf life can be considerably longer than the life of a pre-mixed drink. Moreover, drink mixes can allow a consumer to customize a particular beverage, such as water, to achieve a desired taste, nutritional supplement or other supplement.

Powders are usually stored in thick, flexible rectangular or square-shaped "packets" lined with aluminum foil, in other appropriate material or in more rigid plastic, tubular containers. The process of adding powder from the package to the water bottle most often occurs with spillage of some of the powder over the edge of the bottle opening, onto the sides of the bottle and onto the surface on which the bottle is resting. As such, the procedure of adding the powdered mixture to the bottle is an inconvenient and messy process that often requires cleaning of the bottle and other surfaces. Additionally, for some mixes that are attempting to achieve a specific desired nutritional or medicinal benefit, the spilling of the mix can lessen the benefit as the specific desired proportion of the mix in the drink is lost when spilled.

Nevertheless, despite these difficulties and inconvenience, there are advantages to using powdered substances as ingredients and/or supplements for nutritional, energy and medical products. One advantage is that, since the powered drink in the mix is in a dry form, its shelf life can be considerably longer than the life of a pre-mixed liquid drink. Moreover, powdered drink mixes can allow a consumer to customize a particular beverage by adding different quantities of the powdered mix to a bottle filled with a liquid such as water to achieve a desired taste and/or nutritional supplement concentration.

Further, for most, if not all, pre-made liquid beverages, preservatives such as EDTA (Ethylenediaminetetraacetic acid), sodium benzoate, potassium sorbate and other chemicals must be used to prevent the growth of bacteria, mold and fungi. Most such chemical agents are active only at acidic pH values below 3.5 or 3.0. Commercially available pre-mixed liquid drinks, regardless of their content of nutritional, supplement and/or medical ingredients are maintained at or below this pH level. Using powdered mixes is advantageous because they can be prepared without such chemical preservatives and the pH value can be adjusted to be in the biologically neutral range of pH 7.0. This is beneficial for most consumers, particularly children who already consume an excess of extraneous and deleterious chemicals contained within the hundreds of pre-mixed liquid drinks which they currently consume.

From the foregoing it will be appreciated that what is needed is a drink mix container that can store a powdered substance, which can be subsequently added to a liquid within a commercially-available water bottle (or to a liquid such as mild juice, flavored water beverage, etc. within a suitable container in a simple clean efficient and quantitative manner.

SUMMARY OF THE INVENTION

The aforementioned needs are satisfied, in one implementation, by a Drink Mix Container (DMC) that defines a central receptacle that receives the drink mix which can be a dry, powdered mix or even a liquid mix. The receptacle includes a first and a second opening. The first opening (which can be positioned towards the bottom of the receptacle) and the second opening (positioned towards the top of the receptacle) each project from the receptacle through an extended "neck" region. The first opening is sized and configured to be positioned onto the opening of a commercially available water bottle or suitable drink container. The first opening also preferably includes a first cap that seals the first opening so the first opening may be threaded on both the interior and the exterior. In one non-limiting implementation, the exterior (outer) threads on the neck region of the first opening permit a "threaded" lid or cap to be affixed, which seals the first opening. The interior neck of this first opening is divided into a proximal (joining the receptacle) and a distal region. When this cap is removed, the interior threads on the distal region the neck of the first opening permit the DMC to be firmly attached to a commercial water bottle or other suitable drink container. The proximal region of the inner side of the neck of the first opening is either threaded or smooth in nature.

The second opening is preferably sized and positioned so that when the DMC is positioned on the water bottle or suitable drink container, via the first opening, the second opening functions as the opening of the water bottle or drink container so that mixed drink flows from the water bottle or drink container through the receptacle of the DMC and out of the second opening, to be consumed.

The second opening towards the top of the DMC is, in one non-limiting example, sized and configured with threads along only the outer surface of the neck region to permit a "threaded" lid or cap to be affixed to it, which thus seals the opening. The second opening is preferably sized and positioned so that when the DMC is attached to the commercial water bottle or drink container, via the first opening, as described in the above paragraph, the second opening then functions as the opening through which the drink mixture is consumed.

As such, after the release of the powder from the DMC into the water bottle or suitable container and the powder is mixed with the liquid content of a water bottle, the mixed liquid can then be consumed directly through the second opening, without removal of the DMC from the water bottle.

In one specific non-limiting implementation there is a removable plug that extends through the receptacle and seals the first opening (from the inside) so that the powdered (or liquid) mix is retained within the receptacle when the cap is removed from the first opening and the drink mix container is positioned on the water bottle or suitable drink container. After attachment of the DMC to the water bottle, the plug can be removed from the inside through the top opening of the DMC, so as to release the mix from the receptacle allowing it to fall into the liquid content of the water bottle or suitable drink container.

In one non-limiting application the inner surface of the proximal region of the first opening (toward the bottom region of the DMC) is either threaded or is smooth (without threads). In one implementation, the inner proximal surface of the neck region of the first opening is smooth and the removable plug comprises a "push-pull" plug that is positioned within the neck region of the first opening. The "push-pull" plug can be spherical, elliptical, oval, or formed in some other three-dimensional shape. It can be "rigid" (either solid or hollow in construction) so that it is tightly "juxtaposed" against an appropriate "complementary surface" within the neck region of the first opening, or it can be "flexible" (either solid or hollow in construction) so that it is "friction fit," "squeezed" or "pushed" into the neck region of the first opening. In this configuration, the "push-pull" plug may be slightly deformed as it is "positioned" (friction-fit, pushed, or squeezed) to form the seal within the neck region of the first opening.

In another implementation, the inner proximal surface of the neck region of the first opening is "threaded" and the removable plug comprises a "threaded-twist" plug that is positioned within the neck region of the first opening, so as to permit a "threated engagement." This "threaded-twist" plug may have a flexible, encompassing (surrounding or circumscribing) "flap" attached to the upper edge which projects onto the inner surface of the inner receptacle wall to help provide an effective seal to prevent the loss of the powdered mix.

In either of these implementations, the plugs can be attached to the second cap and can be removed by removal of the second cap; the connection of the plug to the second cap may be a fixed connection or a threaded connection. The attachment may be by a stem that is sufficiently flexible to permit the second cap to be displaced laterally to permit the drink mix to be deposited into the DMC receptacle during the filling process by moving the second cap aside. The stem must be sufficiently long enough so that when the second cap is not threaded to the second (top) opening, the plug is still positioned in the proximal neck region of the first (bottom) opening to prevent the drink mix from into the water or drink bottle.

Alternatively, in either of these implementations, the plugs ("push-pull" plug or the "threaded-twist" plug) can be attached to the second cap by a rigid or flexible "stem" (or rod) that extends from the plug, upwards through the receptacle space, and is attached to the second cap by a "fixed" or a "threaded" connection. Removal of the second cap has the effect of "removing" the "plug" from the neck region of the first opening (by lifting it "upwards" and out of the neck region of the first opening) so that the ingredients within the receptacle are thereby released into the water of the commercial water bottle or into the liquid contents of any suitable container.

The plug may also have flexible flaps to retain the drink mix by forming a seal. These seals may extend diagonally outward from the top of the plug.

To facilitate the filling process, in another implementation, the receptacle can have a separate opening for adding the mix into the receptacle which means the stem can be shorter.

These and other objects and advantages of the present invention will become more apparent from the following description and drawings.

DETAILED DESCRIPTION OF THE PREFERRED EMBODIMENT

Figure 1:
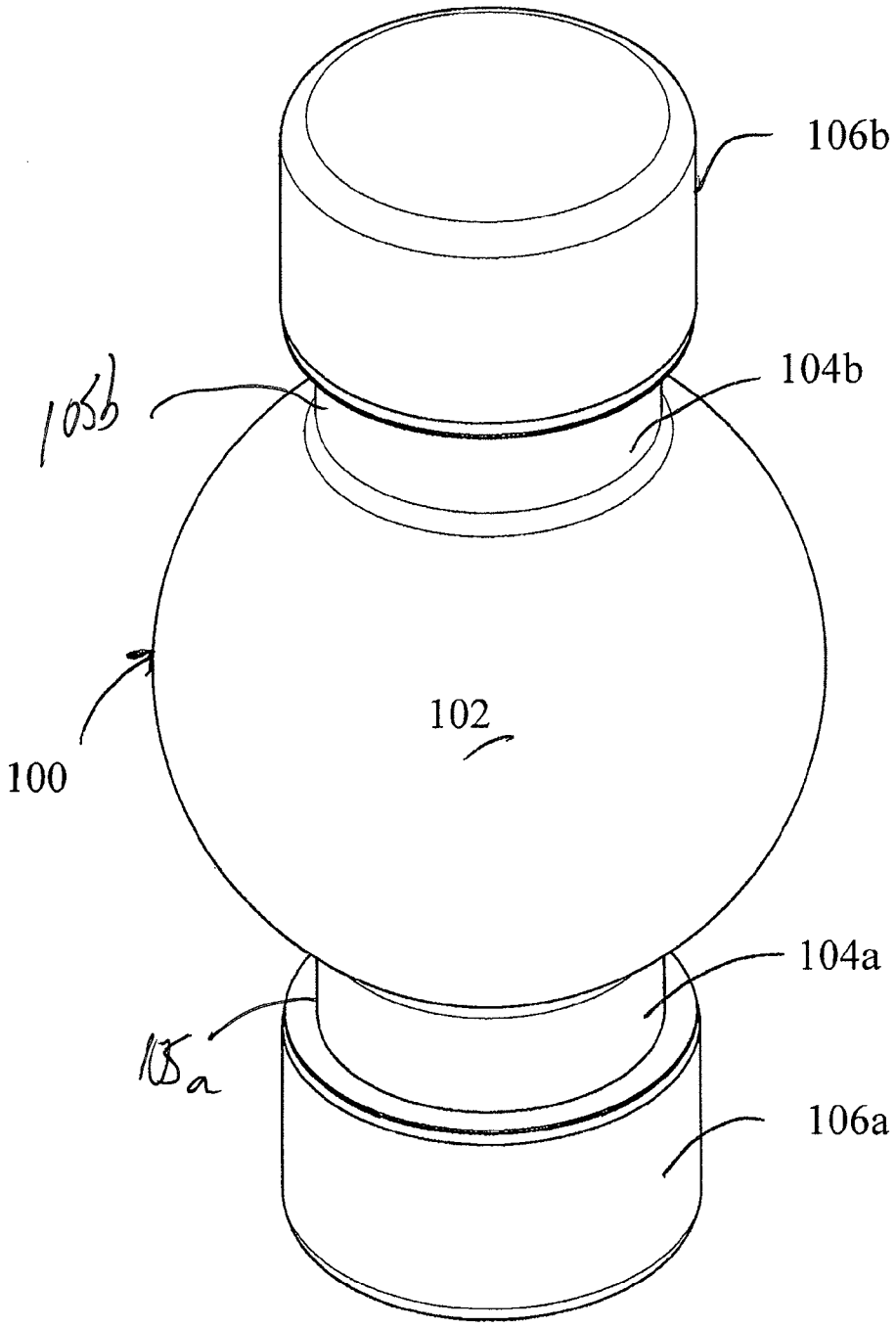
FIG. 1 is an elevation view of one embodiment of a drink mix container.

Reference will now be made to the drawings wherein like numerals refer to like parts throughout. Referring to FIG. 1, an embodiment of a drink mix container (DMC) 100 is shown. The DMC 100 has a receptacle 102 where the drink mix is stored and a first and a second opening 104*a*, 104*b*. The receptacle 102 is shown to be spherical in FIG. 1, however, a person of ordinary skill in the art can appreciate that the shape of the receptacle can vary without departing from the spirit and scope of the present invention. Other optional shapes can be cuboidal, elliptical, oval and any other different type of geometric shape.

As shown, the openings 104*a*, 104*b* are covered by caps 106*a*, 106*b*. In one specific implementation, necks 105*a*, 105*b* of the openings 104*a*, 104*b* are covered with threads 107 (shown in FIGS. 2 and 3) that receive threads along the inner sides of the caps 106*a*, 106*b* (shown for cap 106*b* in FIGS. 2 and 3). It will be appreciated however, that the caps 106*a*, 106*b* can be attached to the necks 105*a*, 105*b* in any manner known in the art.

As is also shown, the openings 104*a* and 104*b* are positioned at the bottom and top of the DMC respectively, and are generally aligned with each other. As will be discussed below, the openings 104*a* and 104*b* allow for the introduction of the drink mix into any commercially-available water bottle or suitable drink container and also optionally allow a person to consume the drink with the mix deposited in the water bottle or suitable drink container through the neck region 105*b* of the DMC 100. Hereinafter, the term "water bottle" will be used to designate any commercially-available water bottle or any suitable drink container that may or may not contain water or other liquid beverages.

Figure 2:
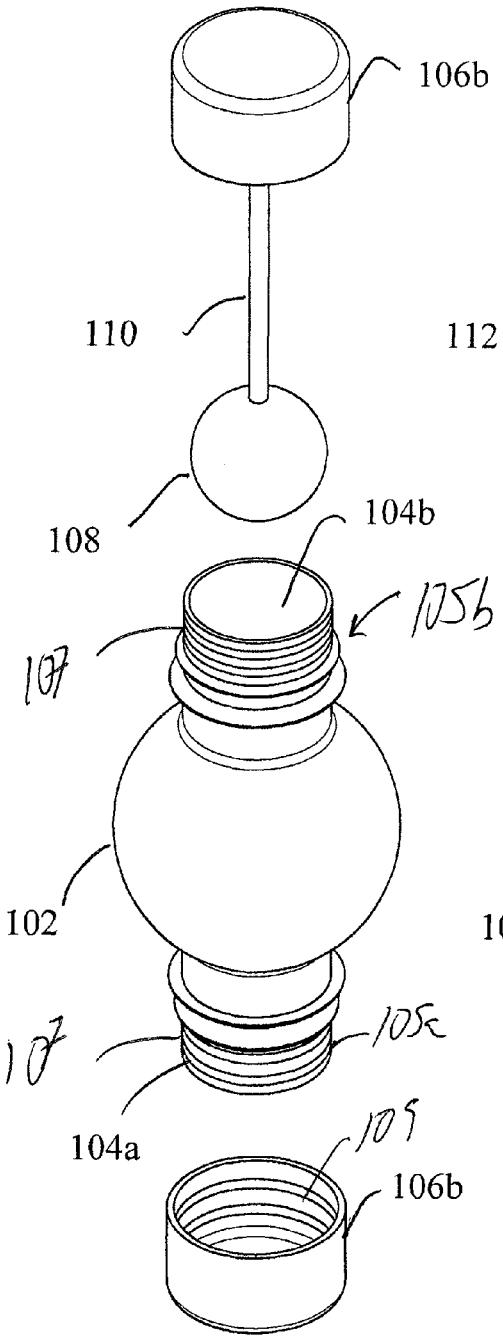
FIG. 2 is an elevation view of the container of FIG. 1 having a push-pull plug.

Referring now to FIG. 2, the DMC 100 will be further described. In this embodiment, the cap 106*b* includes a "push-pull" plug 108 that is attached to the cap via a stem 110. Advantageously, the stem 110 is sized so that when the cap

106*b* is threaded onto the neck 105*b* of the opening 104*b* via the threads 107, the plug 108 is positioned within the neck region 105*a* of the opening 104*a* so as to prevent the drink mix in the receptacle 102 from being deposited into the water bottle or drink container. This permits a user to position the DMC 100 onto the water bottle in a manner that will be described in greater detail below. Once the drink mix container 100 is positioned on the drink container, the user can then remove the cap 106*b* which removes the plug 108 from the neck region 105*a* opening 104*a* causing the drink mix to fall into the water bottle without any spillage of the drink mix.

Figure 3:
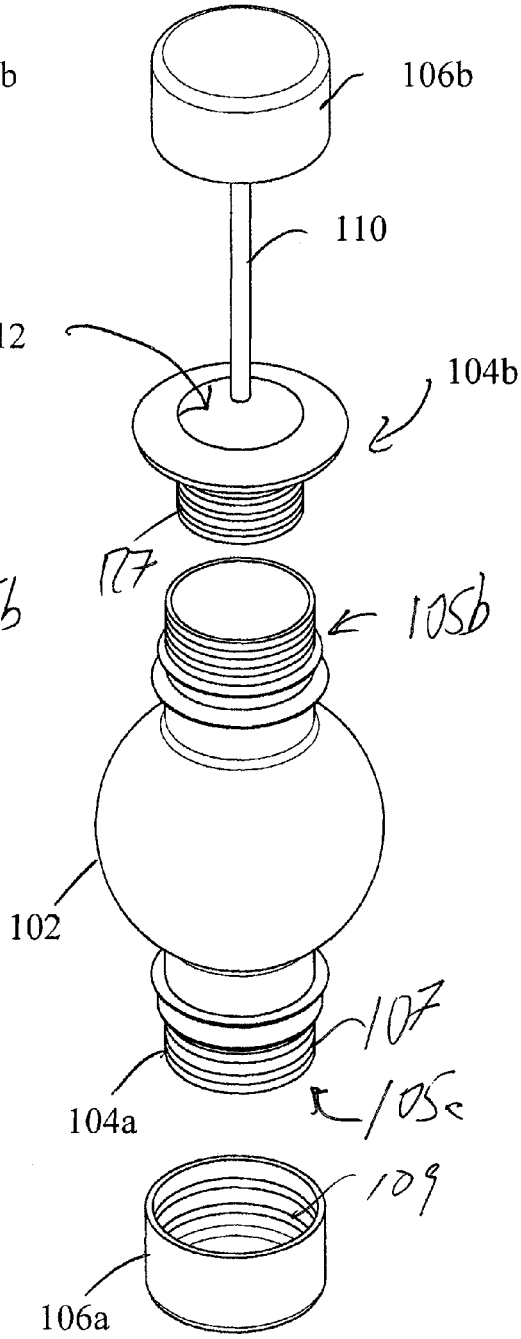
FIG. 3 is an elevation view of the drink mix container of FIG. 1 having a threaded-twist plug.

Referring now to FIG. 3, another embodiment of the DMC 100 will be described. In this embodiment, there is a "threaded-twist" plug 112 that is formed on (or affixed to) a stem 110 that is attached to the cap 106*b*. The twist or threaded plug 112 has threads 113 that engage with threads 125 on the interior surface of the proximal neck region 105*a* of the opening 104*a* (shown in FIGS. 5A-5C) in the manner that will be described in greater detail below. Like the embodiment of FIG. 2, the plug 112 closes the neck region 105*a* of the opening 104*a* and allows the DMC 100 to be positioned on the water bottle without allowing the drink mix to fall into the water bottle until the top cap 106*b* is removed.

In each of these embodiments, the inner walls caps 106*a* and 106*b* preferably have threads 109 (shown for the cap 106*a* in FIGS. 2 and 3) that engage with the threads 107 on the distal outside regions of the necks 105*a*, 105*b* of the openings 104*a*, 105*b* that permit the DMC 100 to be sealed. It will be appreciated that the caps 106*a* and 106*b* may either both be attached via threads or they can be attached in any of a number of different manners known in the art without departing from the spirit and scope of the present invention.

Figure 4A:
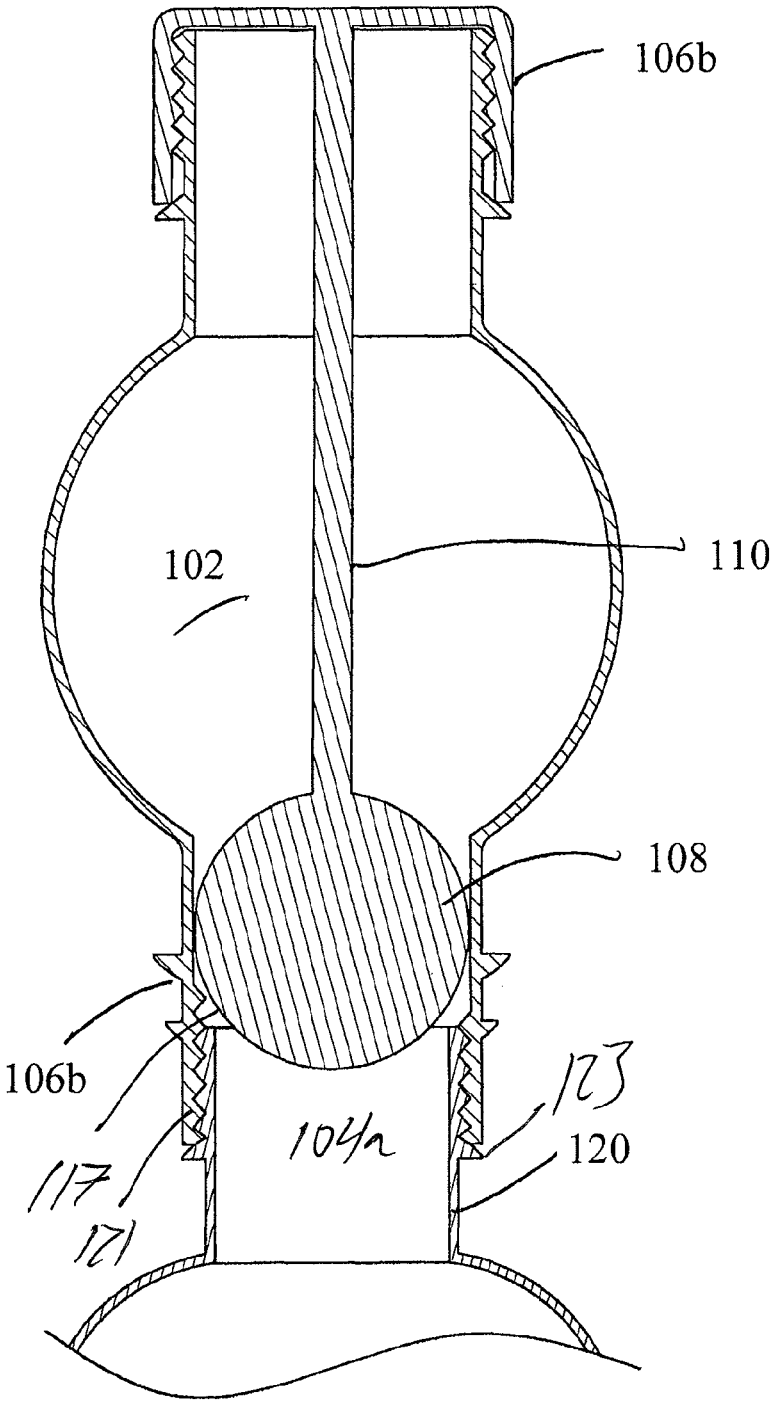
FIGS. 4A-4C are cross-sectional views of another embodiment of the drink mix container of FIG. 1.
Figure 4B:
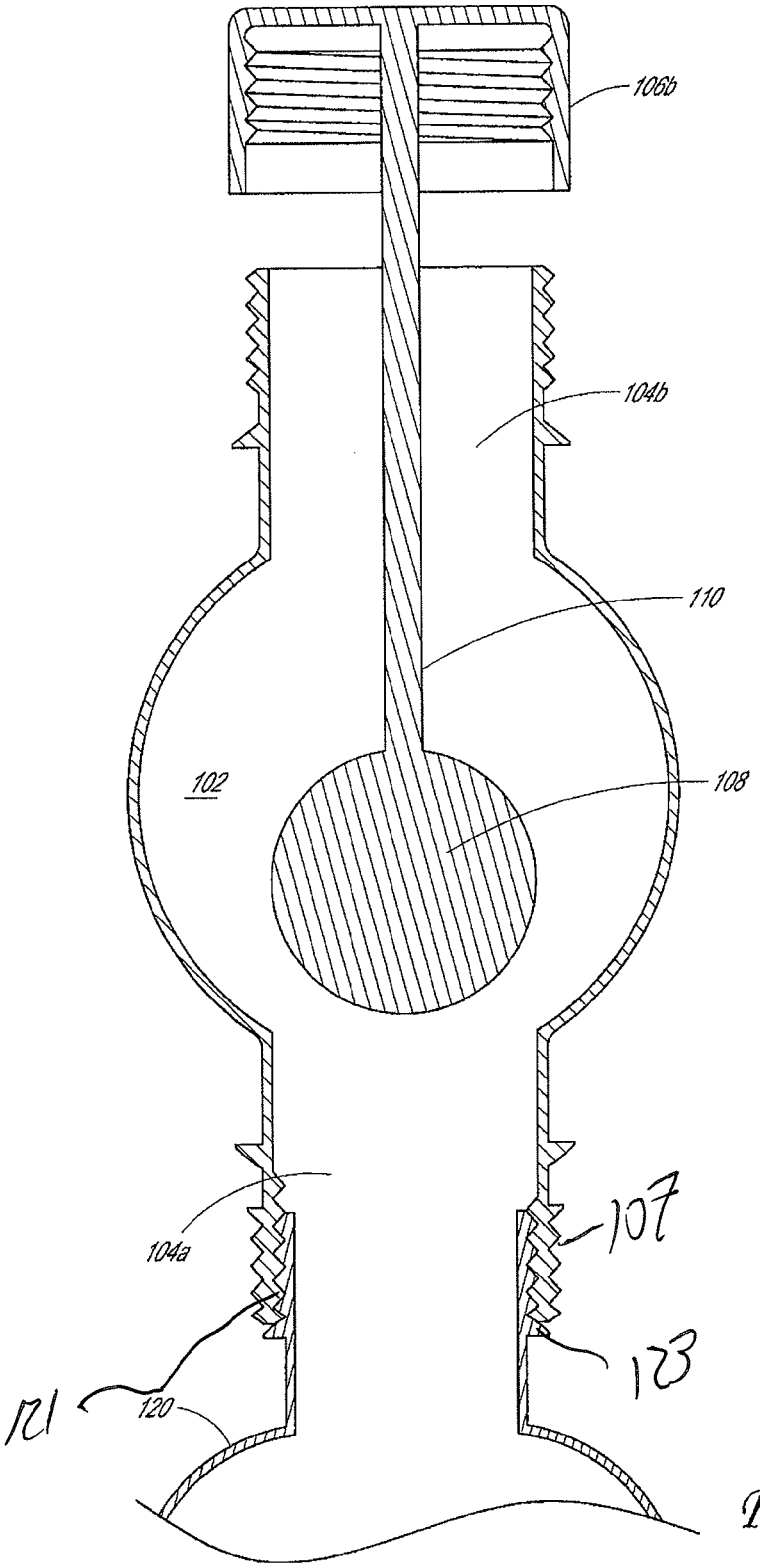
Figure 4C:
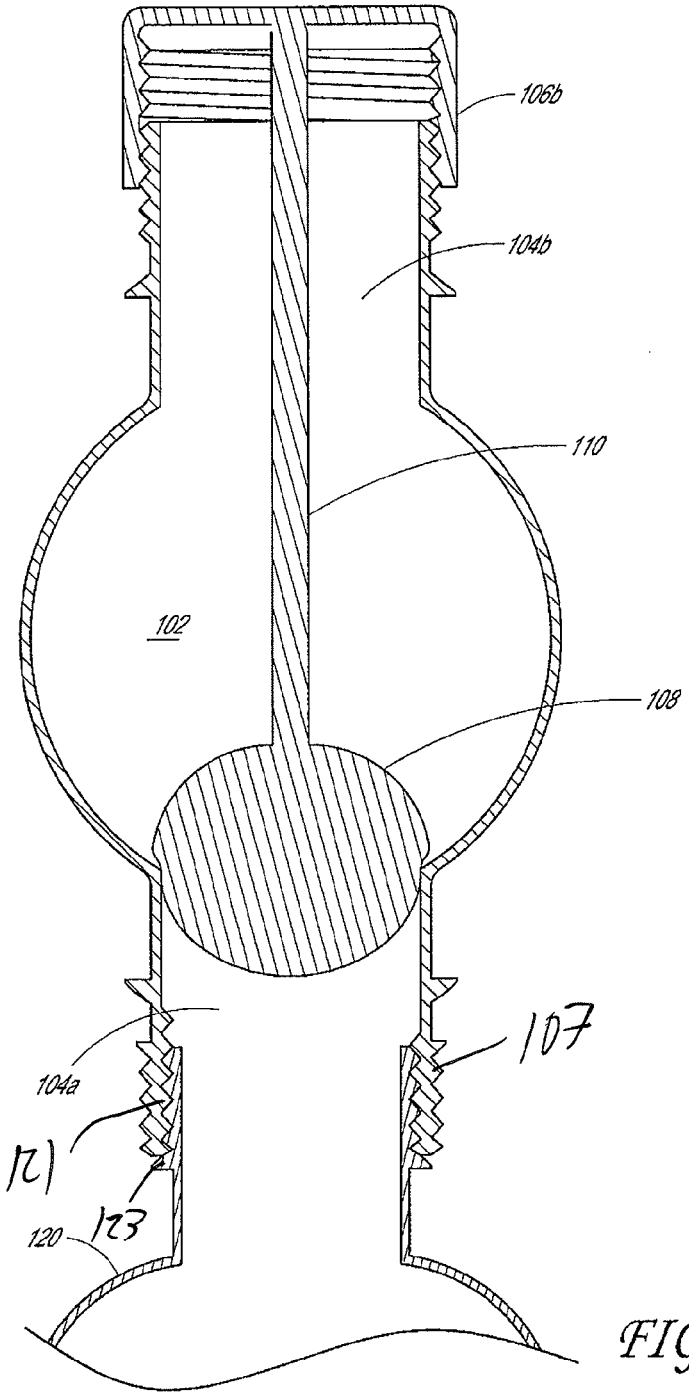

FIGS. 4A-4C illustrates different embodiments of the embodiment of FIG. 3 which seal the second or lower opening 104*a* in different manners. As shown in FIG. 4A, the plug 108 can be sized to fit within the neck region 105*b* of the opening 104*a* in an un-deformed state. The proximal neck region of the opening 104*a* may also include seating members 117 that are sized and positioned so that when the plug 108 is positioned against the sealing member 117, the receptacle 102 is sealed and the drink mix in the receptacle does not fall into a water bottle 120. The seating members 117 may comprise an annular ring that is curved so as to match the curvature of plug 108. In this embodiment, the plug 108 may be formed of a rigid material that is substantially non-deformable or can alternatively comprise a deformable member.

As shown in FIGS. 4B and 4C, in an alternate design, the plug 108 can be larger than the inner region of the neck 105*a* of the opening 104*a* but can be formed of a deformable material such that when the cap 106*b* is screwed onto the outer region of the neck 105*b* of the opening 104*b*, the plug 108 is forced into the proximal neck region of the opening 104*b* and is deformed therein so as to also inhibit the drink mix from falling through the opening 104*a* into the water bottle below. A soft plastic or other suitable material can be used to form this embodiment of the plug 108.

As is also shown in FIGS. 4A-4C, the distal portion of the inner surface neck region 105*a* of the opening 104*a* is also threaded with threads 121. Preferably, these threads 121 are sized so as to match the size of threads 123 of the water bottle 120 to thereby permit the user to thread (or twist) the DMC 100 onto the water bottle 120 after removal of the bottom cap 106*a* from the DMC 100. Once the DMC 100 is correctly installed onto the water bottle 120, removal of the top cap 106*b* results in the plug 108 being removed from the neck region 105*a* of the opening 104*a* which thereby allows the drink mix in the receptacle 102 to fall into the water bottle 120 without any spillage of the drink mix.

As is also shown in FIGS. 4A-4C, the opening 104*b* has a larger diameter than the opening 104*a* to permit easy installation and removal of the plug 108 (and the plug 112) through the opening 104*b*. The openings 104*a* and 104*b* are preferably axially aligned so that the user can consume the drink through the opening 104*b* once the mix from the receptacle 102 has been released into the water bottle 120.

Figure 5A:
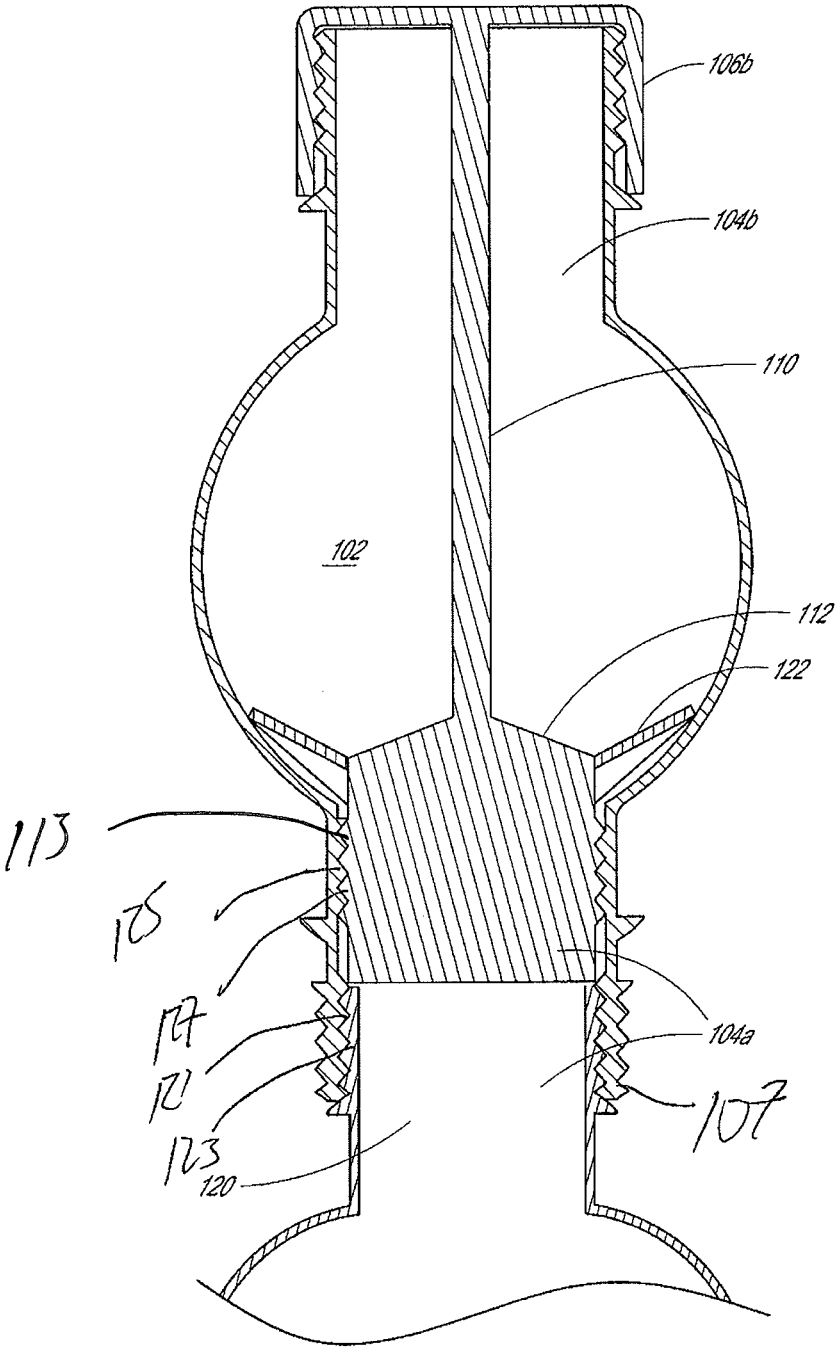
FIGS. 5A and 5B are cross-sectional views of another embodiment of the drink mix container of FIG. 1.
Figure 5B:
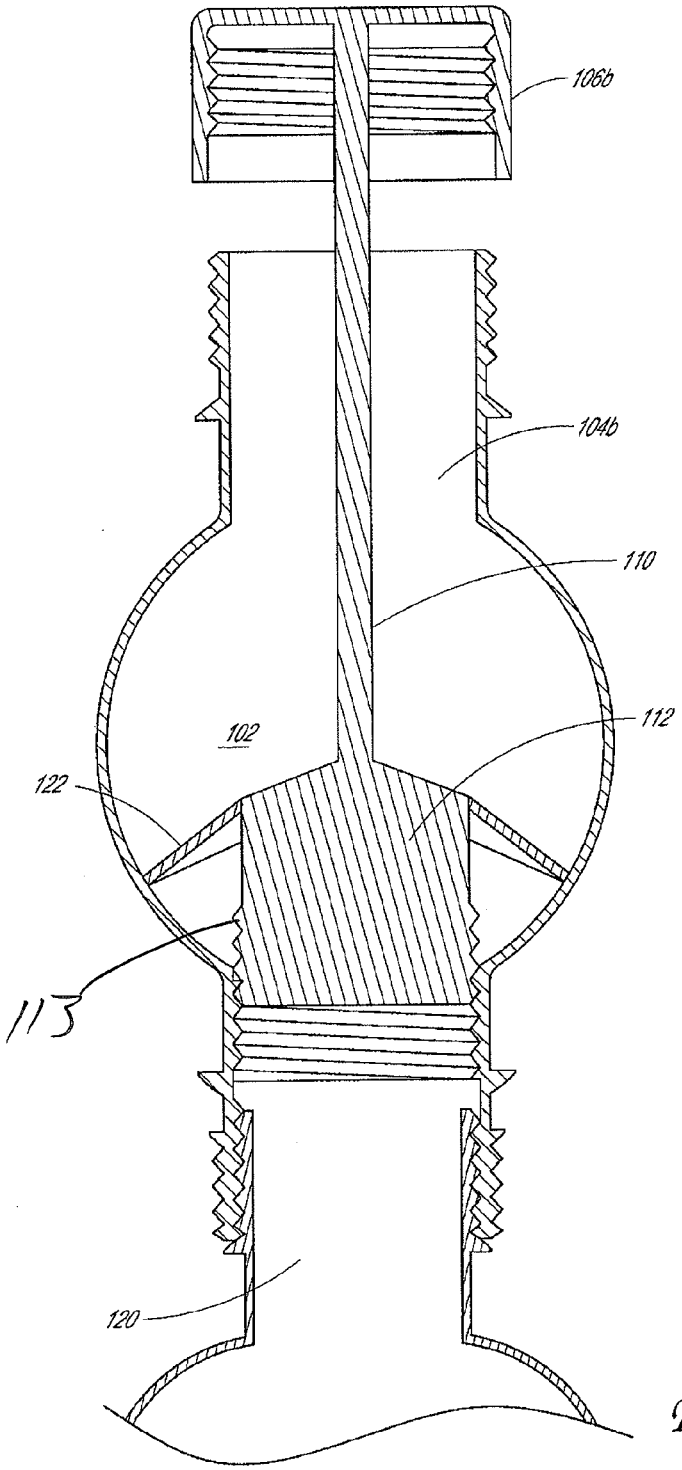

FIGS. 5A and 5B illustrate the manner in which the embodiment of FIG. 3 can be installed and used on the water bottle 120. As shown, the proximal inner neck region 105*a* of the opening 104*a* includes a set of threads 125 that are sized to receive the threads 113 on the "threaded-twist" plug 112. The "threaded-twist" plug 112 is then threaded into proximal inner neck region of the opening 104*a* thereby sealing the receptacle 102 and preventing the drink mix from falling though the opening into the water bottle 120. The distal inner neck region of the opening 104*a* also includes threads 121 that are sized to engage with the threads 123 of the water bottle 120 (See, also, FIG. 4A).

As is also shown, there can be a flexible flange 122 (e.g., an annular flange) that extends outward from the threaded plug 112 (see, also FIG. 3). The flexible flange would help to block the mix from falling into the threads 113 during the filling process and when it is partially inserted into the neck region 105*a* of the first opening 104*a* (see FIG. 5B).

Figure 6A:
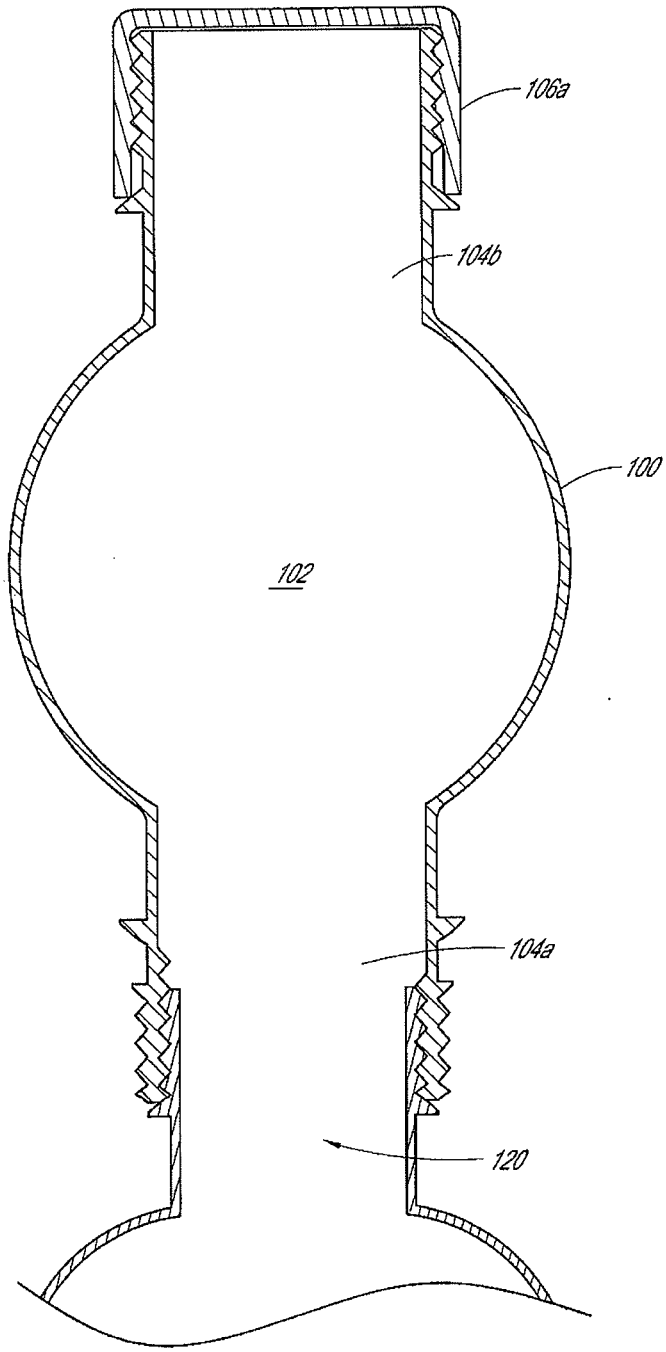
FIGS. 6A and 6B are cross-sectional views of the drink mix container positioned on a drink container.
Figure 6B:
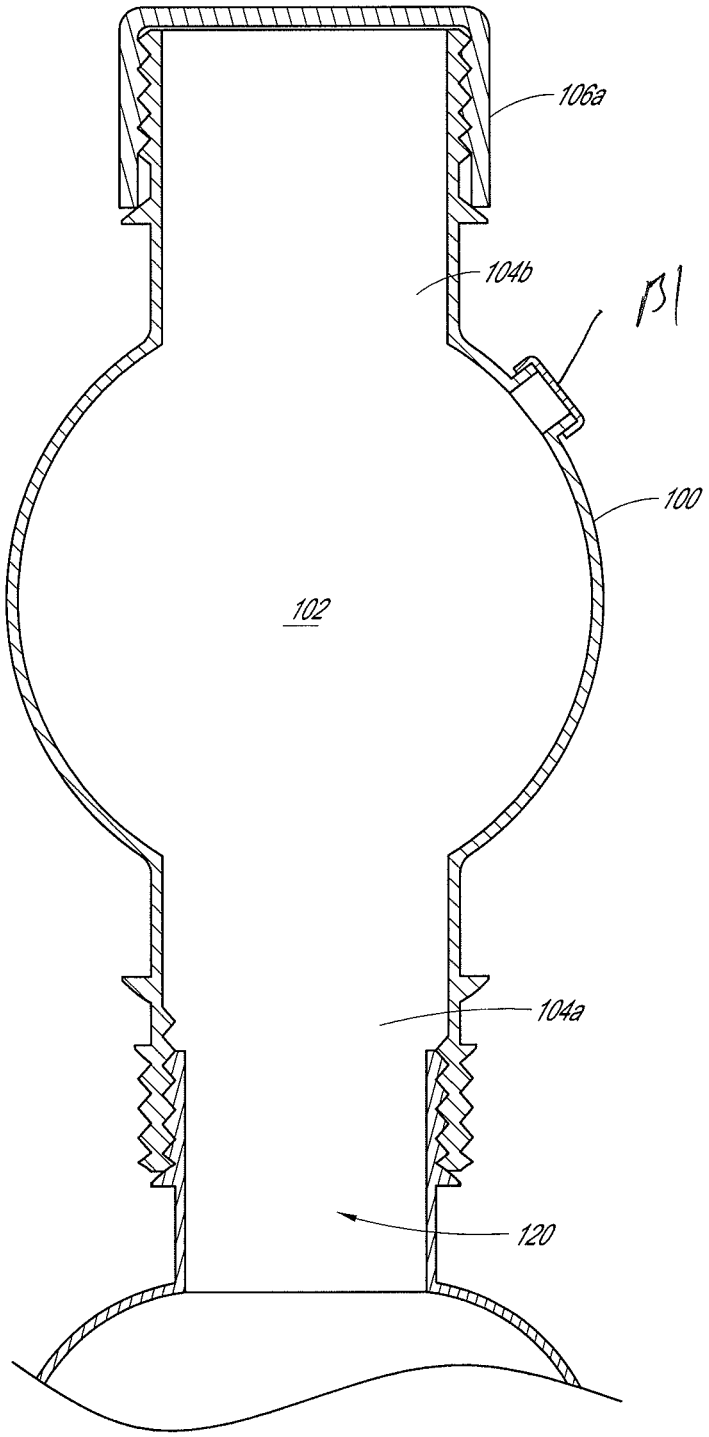

As shown in FIGS. 6A and 6B, in use, the user will remove the cap 106*a* and then thread the DMC 100 onto the water bottle 120 in the same manner as described above. The user can then remove the cap 106*b* (align with the attached stem 110 and plug 108 or plug 112) and discard them. The process of removing the cap 106*b* essentially "unplugs" the proximally neck region of the opening 104*a*, thereby releasing the drink mix contents of the receptacle 102 into the water bottle 120. The user then adds (twists) the cap 106*a* onto the top opening 104*b* to effectively seal the DMC 100 attached to the water bottle 120 to allow the user to shake and mix the contents of the drink mix with the water in the water bottle (or other liquid in any suitable drink container to which the DMC has been attached. After mixing, the user can remove the cap 106*a* and consume the mixed drink (beverage) through the opening 104*b*. As is also shown in FIG. 6B, the receptacle 102 can optionally include a separate port 131 that can be used to fill the receptacle 102 with the mix (which can be a powder or a liquid).

In the embodiments illustrated and described, a DMC 100 with two openings 104*a*, 104*b* that are capped with caps 106*a*, 106*b* can retain a specific quantity of drink mix. The DMCs 100 can be sold separately from the drink bottles. The user can then screw them onto the water bottle (or suitable drink container) when they want to add the drink mix to the water of a commercially-available water bottle or any other liquid in any suitable drink container. The top cap 106*b* with the plug 108 or plug 112 is initially retained on the top opening 104*a* which thereby prevents the drink mix from falling through the opening 104*a* when the cap 106*a* is removed. Removal of the top cap 106*b* removes the plug 108 or 112 which then allows the drink mix to fall into the drink container 120 without spillage. Thus, a specific metered amount of the drink mix can be accurately transferred into the drink container 120.

It will be appreciated that while the foregoing description has shown and described embodiments of the present invention, various changes to the form and use of the described embodiments may be made by those skilled in the art without departing from the spirit and scope of the present invention.

Thus, the scope of the present invention should not be limited to the foregoing discussion, but should be defined by the appended claims.

What is claimed is:

1. A drink mix container, comprising:

a receptacle that is sized to receive a drink mix;

a first and a second opening that are coupled to the receptacle, wherein the first opening is configured to engage with the opening of a drink bottle;

a first and a second cap positioned on the first and second openings;

a removable stopper assembly positioned within the first opening wherein the removable stopper assembly inhibits the drink mix in the receptacle from flowing through the first opening upon removal of the first cap wherein the plug occludes the first opening and the plug is attached to the second cap by a stem so that removal of the second cap results in removal of the plug from the first opening and wherein the plug is threaded and the inner surface of the first opening is threaded so as to receive the threads of the plug so that the plug is threadably with the threads of the first opening to seal the first opening.

2. The container of claim 1, wherein the first and second openings are formed in first and second neck structures respectively that have an inner and outer side and wherein the inner side of the first opening is threaded to threadably engage with the threads of a drink container and wherein the outer sides of the first and second neck structures are threaded to receives the first and second caps.

3. The container of claim 1, wherein the first opening is contoured to have a seating surface that receives the outer contour of the plug to seal the first opening.

4. The container of claim 1, wherein the plug is deformable and is inserted into the first opening so as to seal the first opening.

5. The container of claim 1, wherein a flexible flange extends outward from the threaded plug to contact the inner surface of the receptacle to further inhibit the mix from falling through the first opening.

6. The container of claim 1, wherein the stem is removable.

7. The container of claim 1, wherein the first and second openings are axially aligned so that the mixed fluid in the drink container and the mix can be poured or drunk through the mix container when the mix container is positioned on the drink container and the second cap is removed.

8. The container of claim 1, wherein the mix comprises a dry mix that mixes with water.

9. A drink mix container, comprising:

a receptacle that is sized to receive a drink mix;

a first and a second opening that are coupled to the receptacle, wherein the first opening is configured to engage with the opening of a drink bottle;

a first and a second cap positioned on the first and second openings;

a removable stopper assembly having a plug that positioned within the first opening wherein the removable stopper assembly inhibits the drink mix in the receptacle from flowing through the first opening upon removal of the first cap wherein the plug occludes the first opening and the plug is attached to the second cap by a stem so that removal of the second cap results in removal of the plug from the first opening and wherein the first and second openings are axially aligned and wherein the stem is positioned so as to be axially aligned with the first and second openings and wherein the second opening is larger than the first opening to permit removal of the plug from the second opening.

10. The container of claim 1, wherein the first and second openings are formed in first and second neck structures respectively that have an inner and outer side and wherein the inner side of the first opening is threaded to threadably engage with the threads of a drink container and wherein the outer sides of the first and second neck structures are threaded to receives the first and second caps.

11. The container of claim 9, wherein the first opening is contoured to have a seating surface that receives the outer contour of the plug to seal the first opening.

12. The container of claim 9, wherein the plug is deformable and is inserted into the first opening so as to seal the first opening.

13. The container of claim 9, wherein the plug is threaded and the inner surface of the first opening is threaded so as to receive the threads of the plug so that the plug is threadably engaged with the threads of the first opening to seal the first opening.

14. The container of claim 9, wherein a flexible flange extends outward from the plug to contact the inner surface of the receptacle to further inhibit the mix from falling through the first opening.

15. The container of claim 9, wherein the stem is removable.

16. The container of claim 9, wherein the first and second openings are axially aligned so that the mixed fluid in the drink container and the mix can be poured or drunk through the mix container when the mix container is positioned on the drink container and the second cap is removed.

17. The container of claim 9, wherein the mix comprises a dry mix that mixes with water.

* * * * *